US009322561B2

(12) United States Patent
Ikeda et al.

(10) Patent No.: US 9,322,561 B2
(45) Date of Patent: Apr. 26, 2016

(54) AIR-CONDITIONING APPARATUS AND CONFIGURATION OF INSTALLATION OF SAME

(75) Inventors: Takashi Ikeda, Tokyo (JP); Joseph Paul Bush, Cypress, CA (US); Takashi Okazaki, Tokyo (JP); Tomohiko Kasai, Cypress, CA (US)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 727 days.

(21) Appl. No.: 13/399,650

(22) Filed: Feb. 17, 2012

(65) Prior Publication Data

US 2013/0213614 A1 Aug. 22, 2013

(51) Int. Cl.
*F25D 23/12* (2006.01)
*F24F 3/044* (2006.01)
(Continued)

(52) U.S. Cl.
CPC ..... *F24F 3/044* (2013.01); *F24F 1/0014* (2013.01); *F24F 1/0022* (2013.01); *F24F 13/0209* (2013.01); *F24F 2001/0037* (2013.01)

(58) Field of Classification Search
CPC ..... F25D 17/06; F25D 2317/0672; F24F 1/0014; F24F 1/0022; F24F 13/20
USPC ..... 62/259.1, 426, 407, 411, 412
See application file for complete search history.

(56) References Cited

U.S. PATENT DOCUMENTS 4,662,269 A 5/1987 Tartaglino
6,206,778 B1 3/2001 Smith
6,835,128 B1 12/2004 Olson
(Continued)

FOREIGN PATENT DOCUMENTS

DE 4130651 A1 3/1993
EP 2413058 2/2012
(Continued)

OTHER PUBLICATIONS

Notification of Transmittal of the International Search Report (Forms PCT/ISA 220 and PCT/ISA/210) and the Written Opinion of the International Searching Authority (Forms PCT/ISA/237) dated Aug. 21, 2013, issued in corresponding International Application No. PCT/JP2013/000824. (11 pgs.).
(Continued)

*Primary Examiner* — Jonathan Bradford
*Assistant Examiner* — Elizabeth Martin
(74) *Attorney, Agent, or Firm* — Buchanan Ingersoll & Rooney PC

(57) ABSTRACT

An air-conditioning apparatus includes a body casing of an indoor unit formed in a substantially rectangular parallelepiped shape. The body casing is formed with a body inlet port on a body bottom, and a body outlet port is formed in each body side. The body casing houses a centrifugal fan, a fan motor rotatably driving the centrifugal fan, and an indoor heat exchanger disposed so as to surround an outer periphery of the centrifugal fan in planar view. In each of the body outlet port, a joint is protrudingly provided with a body-side duct connecting portion that connects a duct thereto. Further, outlet ports are formed. The air-conditioning apparatus includes a plurality of outlet units each protrudingly provided with an outlet-side duct connecting portion that connects the duct thereto. Furthermore, at least one of the joints is formed with a plurality of the body-side duct connecting portions.

7 Claims, 10 Drawing Sheets

(51) Int. Cl.

| | |
|---|---|
| ***F24F 1/00*** | (2011.01) |
| *F24F 13/02* | (2006.01) |

(56) References Cited

U.S. PATENT DOCUMENTS

| | | | | |
|---|---|---|---|---|
| 7,204,096 | B2 * | 4/2007 | Iwata et al. | 62/426 |
| 2006/0199503 | A1 * | 9/2006 | Wang | 454/228 |
| 2006/0213216 | A1 * | 9/2006 | Sakashita et al. | 62/419 |
| 2009/0277205 | A1 * | 11/2009 | Matsuda et al. | 62/259.1 |
| 2010/0205993 | A1 | 8/2010 | Matsuda et al. | |
| 2010/0227542 | A1 | 9/2010 | Goldmann et al. | |

FOREIGN PATENT DOCUMENTS

| | | | | |
|---|---|---|---|---|
| GB | 1604376 | | 12/1981 | |
| JP | 61-130821 | U | 8/1986 | |
| JP | 61-189115 | U | 11/1986 | |
| JP | 02-136628 | | 5/1990 | |
| JP | 2001-027428 | A | 1/2001 | |
| JP | 2004-012001 | A | 1/2004 | |
| JP | 2008-256305 | A | 10/2008 | |
| JP | 2009-150578 | A | 7/2009 | |
| JP | 4604313 | B2 | 10/2010 | |
| WO | 2009/104439 | A1 | 8/2009 | |
| WO | WO 2010070889 | A1 * | 6/2010 | F24F 13/28 |

OTHER PUBLICATIONS

Office Action issued Jun. 16, 2015 by the Japanese Patent Office in corresponding Japanese Patent Application No. 2014-538010 (14 pages).

Reasons for Rejection issued Feb. 2, 2016 by the Japanese Patent Office in corresponding Japanese Patent Application No. 2014-538010, and an English translation thereof (13 pages).

* cited by examiner

AIR-CONDITIONING APPARATUS AND CONFIGURATION OF INSTALLATION OF SAME

FIELD OF INVENTION

The present disclosure relates to an air-conditioning apparatus and a configuration of installation of the air-conditioning apparatus.

BACKGROUND OF THE INVENTION

Hitherto, as air-conditioning apparatuses installed in ceilings of rooms, an air-conditioning apparatus has been proposed having a duct connecting a body casing of an indoor unit, which is formed with an inlet port on the bottom side thereof and houses a fan and an indoor heat exchanger therein, to an outlet unit, which is formed with an outlet port opening downwards (in the direction from the ceiling side to the indoor space). In such a conventional air-conditioning apparatus, indoor air is drawn into the body casing and is made to exchange heat, and the conditioned air after exchanging heat is delivered to the indoor space through the outlet port of the outlet unit.

As an air-conditioning apparatus having the above configuration, an air-conditioning apparatus described in Patent Literature 1, for example, is known. The air-conditioning apparatus described in Patent Literature 1 is one known as a built-in-type in which ducts interconnect a body casing (casing 10 in Patent Literature 1) of the indoor unit disposed above a ceiling and a plurality of outlet units (outlet chambers 30 in Patent Literature 1). In the air-conditioning apparatus described in Patent Literature 1, the body casing is formed in a substantially rectangular parallelepiped shape having only in one sidewall thereof a plurality of body outlet ports that are connected to the ducts (that is, outlet ports to discharge conditioned air to the ducts that are connected to the outlet units). That is to say, the ducts each connected to the outlet units are all connected to a single sidewall of the body casing. Accordingly, the air-conditioning apparatus described in Patent Literature 1 is configured such that the body casing is disposed in a corner of a room.

Further, as regards an air-conditioning apparatus having the above configuration, another air-conditioning apparatus described in Patent Literature 2, for example, is known. In the air-conditioning apparatus described in Patent Literature 2, a body casing (casing 11 in Patent Literature 2) disposed above a ceiling is formed in a substantially rectangular parallelepiped shape having more than two sidewalls of the body casing each with a body outlet port that is connected to a duct (outlet ports 20 in Patent Literature 2). Furthermore, in the air-conditioning apparatus described in Patent Literature 2, each body outlet port of the body casing is configured such that only a single duct is allowed to be connected thereto.

Additionally, as regards an air-conditioning apparatus having the above configuration, still another air-conditioning apparatus described in Patent Literature 3, for example, is known. In the air-conditioning apparatus described in Patent Literature 3, a body casing (indoor unit body 1 in Patent Literature 3) disposed so as to be embedded in a ceiling is formed in a substantially rectangular parallelepiped shape having in each of the two opposing sidewalls of the body casing a body outlet port that is connected to a duct (first auxiliary outlet ports 17 in Patent Literature 3). That is, the air-conditioning apparatus described in Patent Literature 3 is provided with two outlet units (outlet port units 32 in Patent Literature 3) that are connected to the two opposing sidewalls of the body casing through ducts. Furthermore, in the air-conditioning apparatus described in Patent Literature 3, an indoor heat exchanger (heat exchanger 15 in Patent Literature 3) is formed in a substantially rectangular shape in planar view. This indoor heat exchanger is housed in the body casing so as to surround a fan in planar view. The air-conditioning apparatus described in Patent Literature 3 is further provided with an opening formed on the bottom side of the body casing and a decorative panel (outlet panel 2 in Patent Literature 3) covering this opening on the bottom side. In this decorative panel, in planar view, an inlet port is formed in the position corresponding to the inner side of the indoor heat exchanger. Further, in this decorative panel, in planar view, four outlet ports (main outlet ports 22 in Patent Literature 3) are formed in positions between the indoor heat exchanger and the sidewalls of the body casing, and along the sidewalls of the body casing. That is, the air-conditioning apparatus described in Patent Literature 3 is configured such that outlet ports surrounding the inlet port are also formed in the body casing. Accordingly, conditioned air that has exchanged heat in the indoor heat exchanger is discharged into the indoor space from the outlet ports of the outlet units, as well as from the outlet ports formed in the body casing (outlet ports formed so as to surround the inlet port).

CITATION LIST

Patent Literature

Patent Literature 1: Japanese Unexamined Patent Application Publication No. 2009-150578 (paragraphs 0010 and 0012, and FIGS. 1 and 2).

Patent Literature 2: Japanese Unexamined Patent Application Publication No. 2001-27428 (paragraph 0027 and FIGS. 1 to 3).

Patent Literature 3: Japanese Patent No. 4604313 (paragraphs 0103 to 0108, and FIGS. 17 and 18).

SUMMARY OF THE INVENTION

The air-conditioning apparatus described in Patent Literature 1 is configured such that the body casing of the indoor unit is disposed in a corner of a room, that is, configuration is such that the inlet port of the indoor unit is disposed in a corner of a room. Accordingly, since air tends to stagnate in the area of the room far from the body casing, problems such as poor circulation of the air in the indoor space and low comfortability (not being able to turn the room into a comfortable environment) are encountered.

Furthermore, in the air-conditioning apparatus described in Patent Literature 1, there are cases in which an outlet unit is disposed in the corner opposite to the corner disposed with the body casing in order to air condition the whole room. Problems such as requiring a long duct to connect the body casing and the outlet unit and increase of ventilation resistance in the duct are associated with these cases. If the body casing is disposed in the middle area of the room, the duct can be prevented from being long, but when attempting to dispose an outlet unit on the opposite side of the body casing sidewall in which the body outlet port is formed, the duct has to be bent around 180 degrees, leading to further increase of ventilation resistance in the duct. As a result, in the air-conditioning apparatus described in Patent Literature 1, because ventilation resistance in the duct increases, the torque of the fan motor rotatably driving the fan to maintain the required air volume increases, and accordingly, the power consumption increases, disadvantageously leading to less energy saving (poor energy efficiency). Moreover, the rotation speed of the fan becomes high and noise disadvantageously becomes worse.

Furthermore, because the air-conditioning apparatus described in Patent Literature 2 is configured such that only a single duct is allowed to be connected to each body outlet port of the body casing, the conditioned air that has passed through the indoor heat exchanger is impinged on the sidewall of the body casing, and accordingly, ventilation resistance is increased. As a result, in the air-conditioning apparatus described in Patent Literature 2, because the torque of the fan motor rotatably driving the fan to maintain the required air volume increases, the power consumption increases, disadvantageously leading to less energy saving (poor energy efficiency). Moreover, the rotation speed of the fan becomes high and noise disadvantageously becomes worse.

In addition, because the air-conditioning apparatus described in Patent Literature 2 can be provided with only four outlet units, that is, because there are only four outlet ports that deliver conditioned air to the indoor space, the temperature difference in the room becomes large, leading to a problem such as low comfortability (not being able to turn the room into a comfortable environment).

Additionally, because the air-conditioning apparatus described in Patent Literature 3 is configured such that outlet ports surrounding the inlet port are also formed in the body casing, the conditioned air discharged from the outlet ports of the body casing is directly sucked in from the inlet port. Accordingly, in the air-conditioning apparatus described in Patent Literature 3, short cycles that hinder the air conditioning of the room occur, disadvantageously leading to less energy saving (poor energy efficiency).

Furthermore, in the air-conditioning apparatus described in Patent Literature 3, air passages from the heat exchanger to the outlet ports of the body casing and air passages from the heat exchanger to the outlet ports of the outlet units through the ducts are located in parallel at the downstream side of the indoor heat exchanger. Accordingly, most of the conditioned air that has exchanged heat in the indoor heat exchanger flows to the outlet ports of the body casing that have short distances from the heat exchanger and that have low ventilation resistance, and the conditioned air tends not to flow to the outlet ports of the outlet units that have long ducts and, thus, that have high ventilation resistance. Accordingly, in the air-conditioning apparatus described in Patent Literature 3, the temperature difference in the room becomes large, leading to a problem such as low comfortability (not being able to turn the room into a comfortable environment).

The present disclosure relates to addressing the above and other problems and to obtain an air-conditioning apparatus that is capable of increasing the comfortability in a room, that has high energy savings (high energy efficiency), and that has low noise.

An air-conditioning apparatus according to the disclosure includes a body casing of an indoor unit having a substantially rectangular parallelepiped shape, the body casing being formed with a body inlet port on the bottom side, being formed with a body outlet port on each of the four lateral sides, and being disposed in a ceiling; a centrifugal fan provided inside the body casing; a fan motor rotatably driving the centrifugal fan; an indoor heat exchanger provided inside the body casing, the indoor heat exchanger disposed so as to surround an outer periphery of the centrifugal fan in planar view; a joint provided in each body outlet port, the joint being protrudingly provided with a body-side duct connecting portion that is connected to a duct; and a plurality of outlet units each provided with an outlet-side duct connecting portion that is connected to the duct, each of the outlet units being connected to either one of the body-side duct connecting portions through the duct and being formed with an outlet port on a bottom side thereof, in which at least one joint is formed with a plurality of the body-side duct connecting portions, at least one duct can be connected to each lateral side of the body casing through the joint, and at least five ducts can be connected to the entirety of the body casing.

The air-conditioning apparatus according to the disclosure is configured such that at least one duct can be connected to each and every sidewall of the body casing of the indoor unit through a joint. Thus, the body casing can be disposed in the middle area of the room. Accordingly, satisfactory circulation of the air in the room can be achieved. Furthermore, since the indoor heat exchanger, in planar view, is disposed so as to surround the centrifugal fan (a turbo fan, for example), the conditioned air can be distributed to each of the ducts connected to the sidewalls of the body casing through a joint in a substantially uniform manner. That is, the conditioned air can be distributed to the outlet units that are disposed in arbitrary positions (in all four directions of the room, for example) in a substantially uniform manner. Furthermore, in the air-conditioning apparatus according to the disclosure, since a plurality of ducts can be connected to at least one sidewall of the body casing through a joint, at least five ducts can be connected to the entirety of the body casing. That is, the air-conditioning apparatus according to the disclosure can connect a greater number of ducts to the body casing compared to that of conventional air-conditioning apparatuses, and, thus, a greater number of outlet units can be provided to a ceiling compared to conventional air-conditioning apparatuses. Accordingly, in the air-conditioning apparatus according to the disclosure, conditioned air can be supplied to the room from a greater number of outlet ports of the outlet units than conventional air-conditioning apparatuses. Furthermore, in the air-conditioning apparatus according to the disclosure, since conditioned air can be supplied to the room from a greater number of outlet ports of the outlet units than conventional air-conditioning apparatuses, outlet ports do not have to be provided to the body casing. Thus, in the air-conditioning apparatus according to the disclosure, nonuniformity of temperature in the room is eliminated and comfortability is improved.

It should be noted there are cases in which a connecting piping (a U-shape piping, for example) that connects each refrigerant piping of the indoor heat exchanger to each other is disposed in an edge portion of the indoor heat exchanger. Further, in the edge portion of the indoor heat exchanger, a connecting piping connecting the refrigerant piping of the indoor heat exchanger to the other components of the refrigerant circuit (a compressor, a four-way valve, an expansion valve, an outdoor heat exchanger, and the like, for example) is connected. Accordingly, in actuality, when disposing the indoor heat exchanger so as to surround the outer periphery of the centrifugal fan in planar view, there are cases in which there is a range that cannot surround the centrifugal fan in the vicinity of the edge portion of the indoor heat exchanger in planar view. However, in the disclosure, even when there is a range that cannot surround the centrifugal fan in the vicinity of the edge portion of the indoor heat exchanger in planar view, expressions such as "indoor heat exchanger disposed so as to surround an (the) outer periphery of the centrifugal fan in planar view" is used.

Additionally, as described above, the air-conditioning apparatus according to the disclosure is configured such that at least one duct can be connected to each and every sidewall of the body casing of the indoor unit through a joint. Accordingly, in the air-conditioning apparatus according to the disclosure, the bending angle of the ducts can be 90 degrees or less when connecting the body casing and the outlet units with the ducts. Additionally, in the air-conditioning apparatus according to the disclosure, since the body casing can be disposed in the middle area of the room, the length of each duct can be made short. Additionally, as described above, in the air-conditioning apparatus according to the disclosure, since a plurality of ducts can be connected to at least one sidewall of the body casing through a joint, at least five ducts can be connected to the entirety of the body casing. Accordingly, the air-conditioning apparatus according to the disclosure allows connection of a greater number of ducts to the body casing than conventional air-conditioning apparatuses. Accordingly, the air-conditioning apparatus of the disclosure is capable of reducing ventilation resistance while conditioned air is supplied to the outlet units, and thus is capable of reducing the torque of the fan motor rotatably driving the fan to maintain the required air volume and reducing the power consumption of the fan motor. Furthermore, in the air-conditioning apparatus according to the disclosure, since outlet ports do not have to be provided to the body casing, occurrence of short cycles that hinder the air conditioning of the room can be prevented. Accordingly, in the air-conditioning apparatus of the disclosure, an air-conditioning apparatus that has high energy savings (high energy efficiency) and low noise can be obtained.

That is to say, with the disclosure, an air-conditioning apparatus that is capable of increasing the comfortability in a room, that has high energy savings (high energy efficiency), and that has low noise can be obtained.

DETAILED DESCRIPTION OF THE PREFERRED EMBODIMENTS

Embodiment

Figure 1:
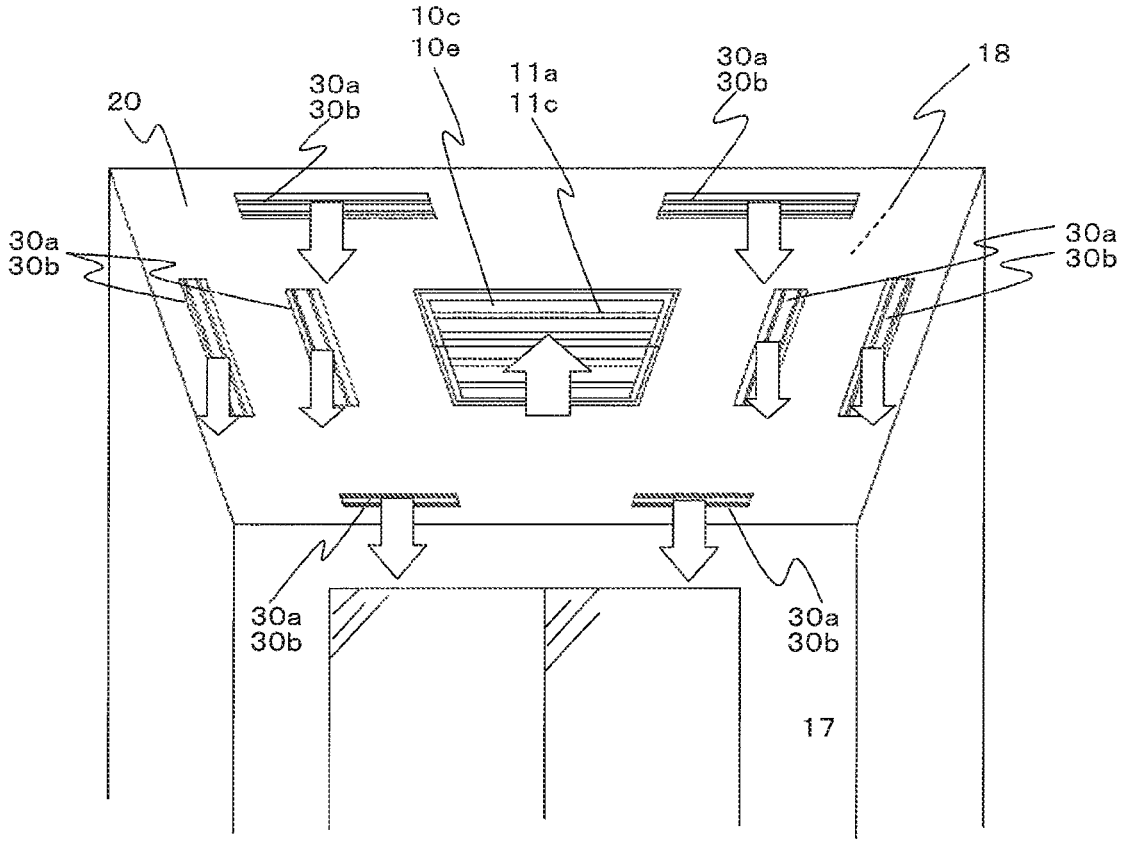
FIG. 1 is a schematic diagram (perspective view) of an installation state of an air-conditioning apparatus according to an exemplary embodiment of the disclosure viewed from inside a room.

Referring to the drawings, an air-conditioning apparatus according to the disclosure will be described below.

Figure 2:
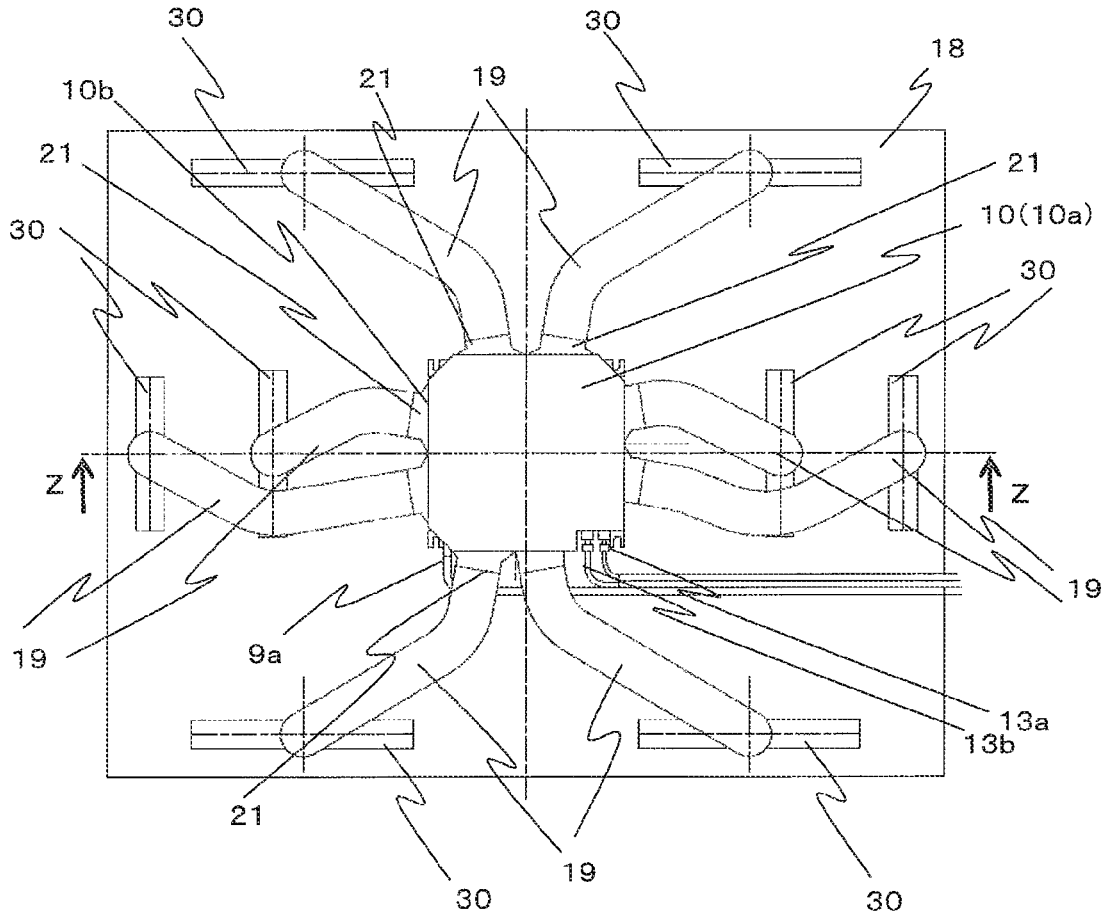
FIG. 2 is a schematic diagram (plan view) of the installation state of the air-conditioning apparatus according to an exemplary embodiment of the disclosure viewed from a space above a ceiling.
Figure 3:
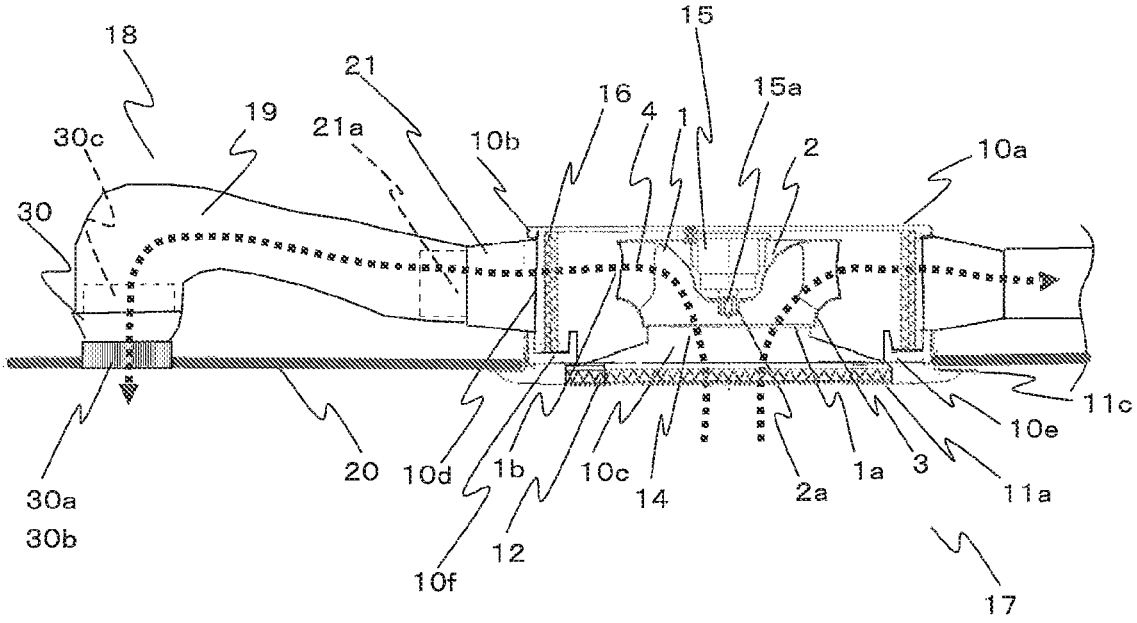
FIG. 3 is a longitudinal sectional view taken along the line Z-Z of FIG. 2.
Figure 4:
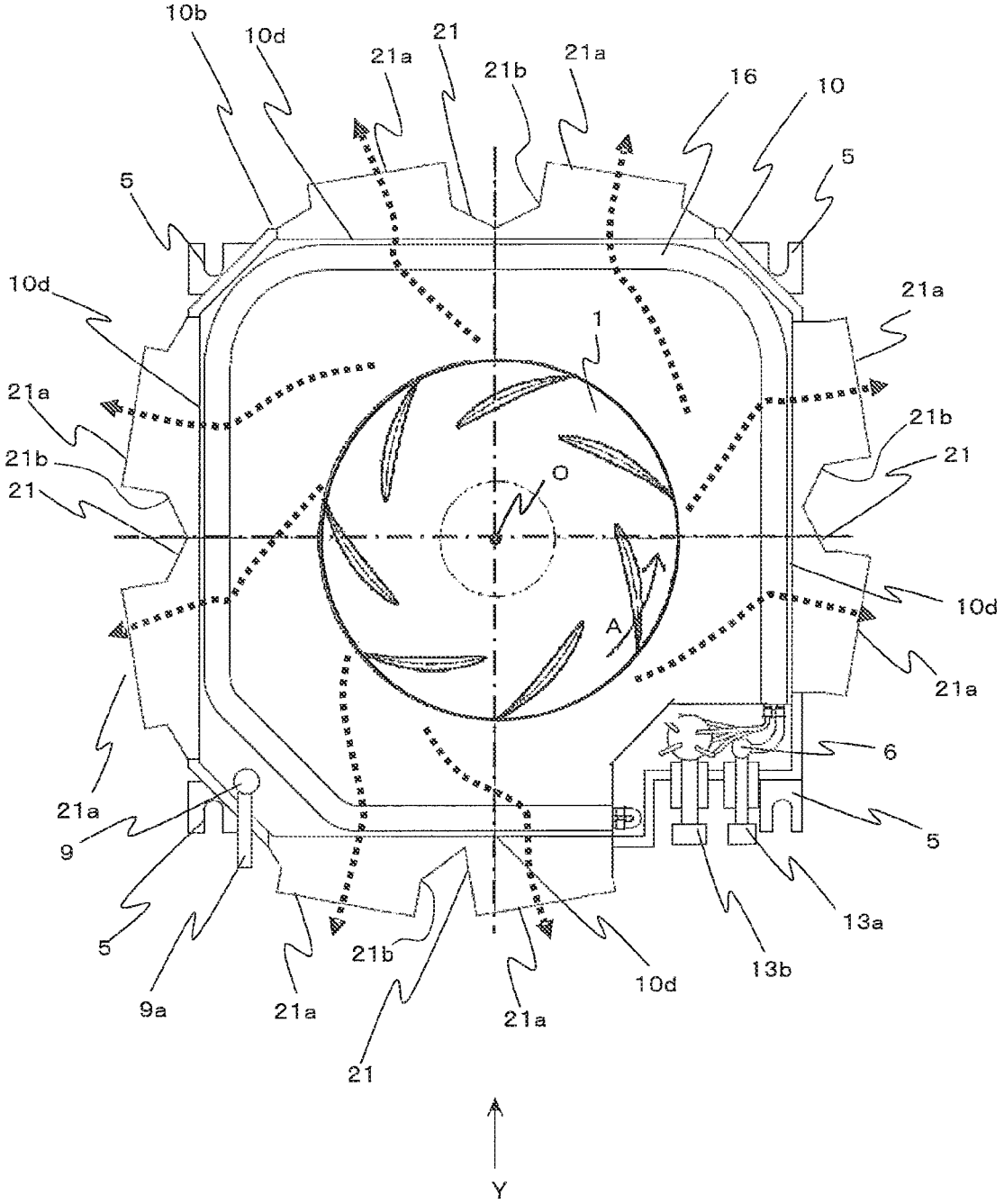
FIG. 4 is a cross sectional view of a body casing of an indoor unit of the air-conditioning apparatus according to an exemplary embodiment of the disclosure taken along a virtual plane orthogonal to a rotation shaft of a centrifugal fan.
Figure 5:
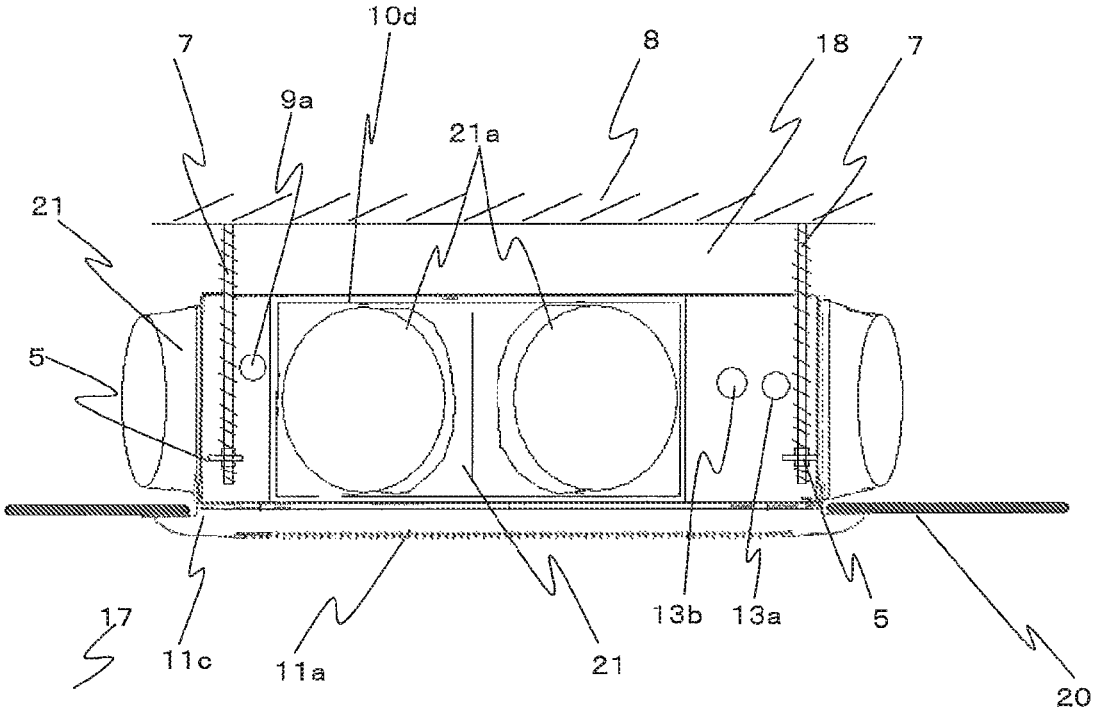
FIG. 5 is an arrow view taken in the direction of an arrow Y of FIG. 4.
Figure 8:
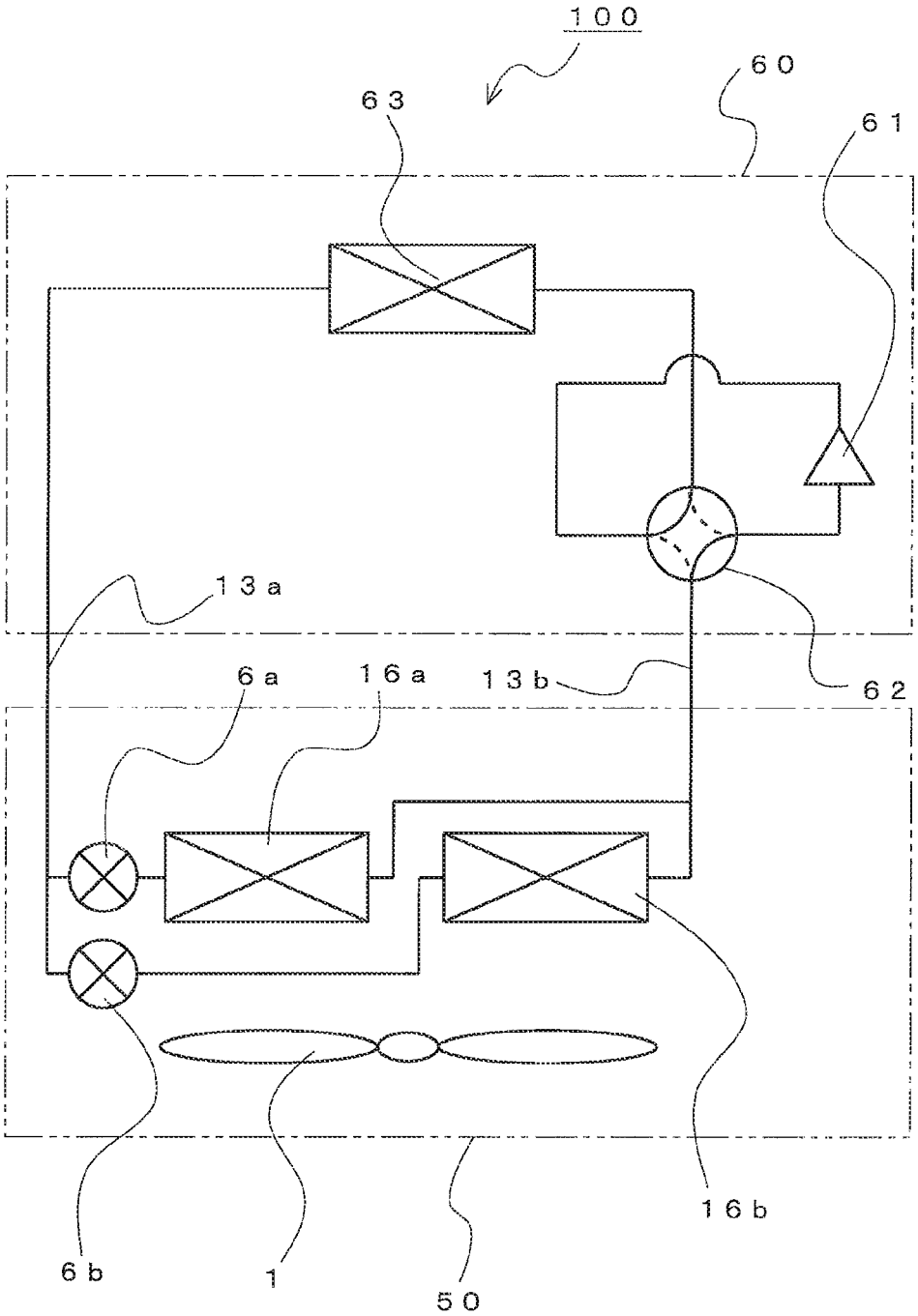
FIG. 8 is a refrigerant circuit diagram of the air-conditioning apparatus illustrated in FIG. 7.

FIG. 1 is a schematic diagram (perspective view) of an installation state of an exemplary embodiment of an air-conditioning apparatus according to the disclosure viewed from inside a room. FIG. 2 is a schematic diagram (plan view) of the installation state of the air-conditioning apparatus according to the disclosure viewed from a space above a ceiling. FIG. 3 is a longitudinal sectional view taken along the line Z-Z of FIG. 2. FIG. 4 is a cross sectional view of a body casing of an indoor unit of the air-conditioning apparatus taken along a virtual plane orthogonal to a rotation shaft of a centrifugal fan (a turbo fan, for example). FIG. 5 is an arrow view taken in the direction of an arrow Y of FIG. 4. FIG. 8 is a refrigerant circuit diagram of the air-conditioning apparatus illustrated in FIG. 6.

An indoor unit 50 of an air-conditioning apparatus 100 according to an exemplary embodiment of the disclosure is provided in a space 18 above a ceiling of a room 17. Further, the indoor unit 50 includes a body inlet port 10*c*, which is an inlet port of the indoor unit 50, and outlet ports 30*a*, which are the outlet ports of the indoor unit 50, that are formed in a separate housing and that are interconnected with a duct. Specifically, the body inlet port 10*c* is formed in the body bottom 10*e* of the body casing 10, and the outlet ports 30*a* are each formed in the bottom side of the corresponding outlet unit 30. Furthermore, since the body casing 10 and the outlet units 30 are connected with ducts 19, the indoor unit is capable of heating or cooling air that has been sucked in from the body inlet port 10*c* of the body casing 10 and discharge conditioned air into the room 17 from the outlet ports 30*a* of the outlet units 30.

As configured as above, the body casing 10 and the outlet units 30 of the indoor unit 50 are provided in the space 18 above the ceiling of the room 17 as illustrated in FIGS. 1 to 3, for example. That is, the body casing 10 is provided at around the middle of the room 17. Further, the plurality of outlet units 30 are each disposed away from the body casing 10 at a predetermined distance. Accordingly, as shown in FIG. 1, the body inlet port 10*c* that is the inlet port of the indoor unit 50 is opened towards the room 17 at around the middle of the room 17. Further, the plurality of outlet ports 30*a*, which are the outlet ports of the indoor unit 50, each open towards the room 17 at a position away from the body inlet port 10*c* at a predetermined distance. Additionally, in the indoor unit 50 according to an exemplary embodiment, an inlet grille 11*a* is provided at a position opposing the body inlet port 10*c*, and outlet grilles 30*b* is provided at positions opposing the corresponding outlet ports 30*a*. Accordingly, when observing a ceiling surface 20 from inside the room 17, the inlet grille 11*a* is provided at around the middle of the room 17, and the plurality of outlet grilles 30*b* are provided at a position away from the inlet grille 11*a* at predetermined distances.

<Detailed Configuration of Indoor Unit 50>

Now, a detailed configuration of the indoor unit 50 according to an exemplary embodiment will be described below in detail.

The body casing 10 is formed into a substantially rectangular parallelepiped shape defined by a body top 10*a*, body sides 10*b*, and a body bottom 10*e*. Further, in the body bottom

10*e*, for example, a substantially rectangular shaped body inlet port 10*c* is formed, and in each of the body sides 10*b*, for example, a substantially rectangular shaped body outlet port 10*d* is formed. Furthermore, in the body bottom 10*e*, on the lower side of an indoor heat exchanger 16 described later, a groove shaped drain receiver 10*f* is formed. In addition, on the body bottom 10*e*, a decorative panel 11*c* is installed from below. In this decorative panel 11*c*, in the range facing the body inlet port 10*c*, an opening is formed, in which the inlet grille 11*a* is openably and closeably installed in this opening. A filter 12 is provided between the inlet grille 11*a* and the body inlet port 10*c*, and by opening the inlet grille 11*a*, the filter 12 can be detached and the indoor unit 50 can be cleaned.

Further, in the body casing 10, a joint 21 is installed to the body outlet port 10*d* of each body side 10*b*. Each connecting portion of the joints 21 and the body outlet ports 10*d* is opened in a substantially rectangular shape corresponding to the shape of the body outlet port 10*d*. In each of these joints 21, on the opposite side of the connecting portion of the joint 21 and the body outlet port 10*d*, two body-side duct connecting portions 21*a* are protrudingly provided for connecting the duct 19 thereto (in other words, inserted into the duct 19). That is, each of the body-side duct connecting portions 21*a* is connected via a duct 19 to the corresponding outlet unit 30. It is assumed that cylindrical ducts 19 are used in an exemplary embodiment. Accordingly, each cross-sectional shape of the body-side duct connecting portions 21*a* is a substantially round shape corresponding to the inner circumference shape of the duct 19.

Note that in an exemplary embodiment, although the body casing 10 and the joint 21 are constituted as separate components, the body casing 10 and the joint 21 may be integrally formed.

Furthermore, each joint 21 is provided with a deformed portion 21*b* in order to suppress ventilation resistance in each joint 21. This deformed portion 21*b* is shaped such that the sections from the connection portion with the body outlet port 10*d* to the body-side duct connecting portion 21*a* gradually deforms its shape from a rectangular into a circle while reducing its cross-sectional area.

Additionally, as regards the plurality of body-side duct connecting portion 21*a* protrudingly provided to the same joint 21, in planar view, the end of the neighboring body-side duct connecting portions 21*a* are protruded so as to part from each other.

As above, since the indoor unit 50 of the air-conditioning apparatus 100 according to an exemplary embodiment is configured such that ducts 19 can be connected to each and every body side 10*b* of the body casing 10 (more specifically, the body outlet port 10*d* of each body side 10*b*) through joints 21, the installing position of the body casing in the space 18 above the ceiling does not have any limitation. Accordingly, as shown in FIGS. 1 and 2, the body casing 10 can be disposed in the middle area of the room 17 in planar view. Thus, as shown in FIG. 2, in the indoor unit 50 of the air-conditioning apparatus 100 according to an exemplary embodiment, the bending angle of the ducts 19 can be 90 degrees or less when connecting the body casing 10 and the outlet units 30 with the ducts 19. Further, the length of each duct 19 can be made short. Furthermore, since the indoor unit 50 of the air-conditioning apparatus 100 according to an exemplary embodiment can connect two ducts 19 to each body side 10*b* of the body casing 10 through joints 21, eight ducts 19 can be connected to the body casing 10, which is greater in number than conventional ones.

It should be noted that although in an exemplary embodiment, an example of connecting two ducts 19 to each body side 10*b* of the body casing 10 through joints 21 is shown, that is, an example in which eight ducts 19 in total is connected to the body casing 10 is shown, the number of ducts 19 is one example. Needless to say, by altering the inner diameter of each duct 19 and the outer diameter of each body-side duct connecting portion 21*a*, further greater number of body-side duct connecting portions 21*a* may be formed in each joint 21 and further greater number of ducts 19 may be connected.

As shown in FIGS. 3 and 4, the above-described body casing 10 is provided with a centrifugal fan 1 serving as an air-sending device, a fan motor 15 rotatably driving the centrifugal fan 1, an indoor heat exchanger 16, and the like.

The centrifugal fan 1 is formed in a substantially cylindrical geometry as a whole, including a main plate 2, a plurality of blades 4, and a shroud 3. The main plate 2 has a substantially circular geometry in planar view and is shaped such that the substantially center portion is protruded downward. In the substantially center portion of this downwardly protruding portion, a boss 2*a* is formed in which a motor rotating shaft 15*a* of the fan motor 15 is fixed thereto. The plurality of blades 4 is provided on the bottom side of the main plate 2, and the lower edge of these blades 4 are provided with the shroud 3 that forms a suction guide wall of the centrifugal fan 1. The fan motor 15 that rotatably drives the centrifugal fan 1 is, in planar view, provided in the substantially center portion of the body top 10*a* of the body casing 10. As regards this fan motor 15, the motor rotating shaft 15*a* is disposed so as to protrude downward, and, as described above, is fixed to the boss 2*a* of the centrifugal fan 1. That is, a fan suction port 1*a* of the centrifugal fan 1 is formed on the bottom side of the centrifugal fan 1 so as to face the body inlet port of the body casing 10. Further, a fan discharge port 1*b* of the centrifugal fan 1 is formed on the centrifugal fan 1 side.

On the upper stream side of this centrifugal fan 1, the filter 12 removing dust from air drawn in from the body inlet port 10*c* is provided so as to face the body inlet port 10*c*. Furthermore, on the upper stream side of the centrifugal fan 1, between the filter 12 and the fan suction port 1*a* of the centrifugal fan 1, a bell mouth 14 guiding the air that has passed through the filter 12 to the centrifugal fan 1 is provided.

The indoor heat exchanger 16 is, in planar view, provided so as to surround the centrifugal fan and is provided on the downstream side of the fan discharge port 1*b*. That is, the indoor heat exchanger 16 is, in planar view, provided between the centrifugal fan 1 and the body sides 10*b* of the body casing 10. In an exemplary embodiment, the indoor heat exchanger 16 is formed along the body sides 10*b* of the body casing 10, and is a substantially rectangular shape (a substantially frame shape) in planar view.

It should be noted there are cases in which a connecting piping (a U-shape piping, for example) that connects each refrigerant piping of the indoor heat exchanger 16 to each other is disposed in an edge portion of the indoor heat exchanger 16. Further, in the edge portion of the indoor heat exchanger 16, connecting pipings (connecting pipings 13*a* and 13*b*, described later) connecting the refrigerant piping of the indoor heat exchanger 16 and the other components of the refrigerant circuit to each other is connected. Accordingly, as shown in FIG. 4, when disposing the indoor heat exchanger 16 so as to surround the outer periphery of the centrifugal fan 1 in planar view, there are cases in which there is a range that cannot surround the centrifugal fan 1 in planar view in the vicinity of the edge portion of the indoor heat exchanger 16. However, in an exemplary embodiment, even when there is a range that cannot surround the centrifugal fan 1 in planar view in the vicinity of the edge portion of the indoor heat exchanger 16, expressions such as "indoor heat exchanger 16 disposed so as to surround the outer periphery of the centrifugal fan 1 in planar view" is used.

Figure 6:
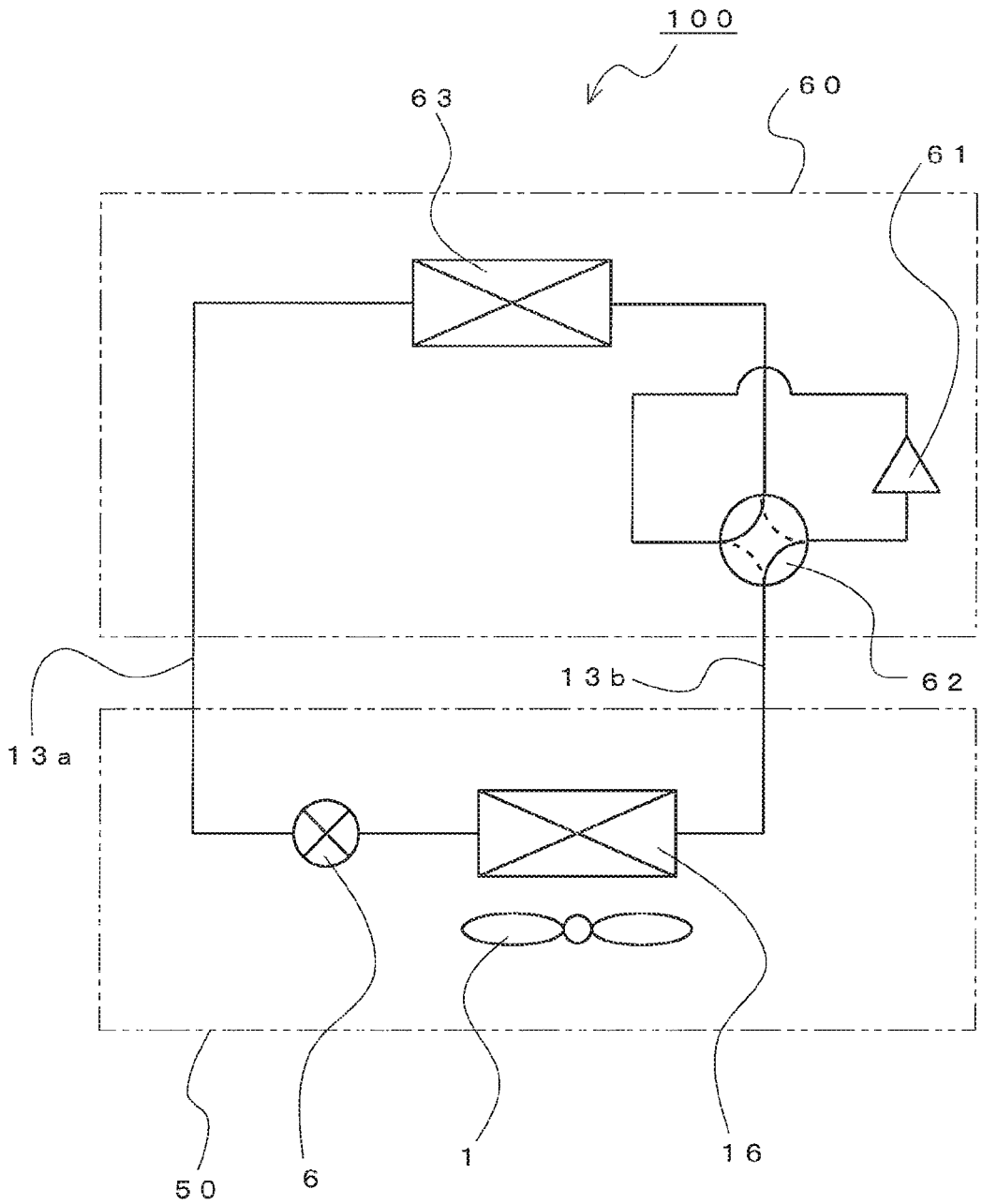
FIG. 6 is a refrigerant circuit diagram illustrating the air-conditioning apparatus according to an exemplary embodiment of the disclosure.

A connecting piping 13*a* and connecting piping 13*b* are connected to this indoor heat exchanger 16. Further, in the connecting piping 13*a*, an expansion valve 6 that expands a refrigerant that has flowed in from the indoor heat exchanger 16 or that has flow out from the indoor heat exchanger 16 is provided. Furthermore, the indoor heat exchanger 16 is, as shown in FIG. 6, connected by pipeline to an outdoor unit 60 that is provided outdoors and the like through the connecting piping 13*a* and connecting piping 13*b*. Specifically, the outdoor unit 60 includes a compressor 61 that compresses the refrigerant, a four-way valve 62 that is a flow switching device of the refrigerant, and an outdoor heat exchanger 63. The discharge side and the suction side of the compressor 61 are connected to the four-way valve 62. Further, the four-way valve 62 is connected to the indoor heat exchanger 16 through the connecting piping 13*b* as well as to the outdoor heat exchanger 63. That is, the four-way valve 62 is configured so as to be able to switch between the passage in which the discharge side of the compressor 61 is connected to the indoor heat exchanger 16 (in other words, a passage in which the suction side of the compressor 61 is connected to the outdoor heat exchanger 63) and the passage in which the discharge side of the compressor 61 is connected to the outdoor heat exchanger 63 (in other words, a passage in which the suction side of the compressor 61 is connected to the indoor heat exchanger 16). Furthermore, the outdoor heat exchanger 63 is connected to the indoor heat exchanger 16 through the connecting piping 13*a* provided with the expansion valve 6.\

It should be noted that although in an exemplary embodiment, the expansion valve 6 is provided in the indoor unit 50, the expansion valve 6 can be provided in the outdoor unit 60.

As described above, in the bottom of the indoor heat exchanger 16 is disposed the drain receiver 10*f* formed in the body bottom 10*e* of the body casing 10. When the indoor heat exchanger 16 functions as an evaporator, and when the indoor air is cooled by the indoor heat exchanger 16 (more specifically, by the refrigerant flowing in the indoor heat exchanger 16), the moisture content in the indoor air is condensed and drain water is generated. This drain water is retained in the drain receiver 10*f*. As such, in an exemplary embodiment, a drain pump 9 is provided to the drain receiver 10*f* and one end of a drain pipe 9*a* is connected to the drain pump 9*a*. Further, the other end of the drain pump 9 is extended to the outside of the room 17. By running the drain pump 9 and sucking up the drain water in the drain receiver 10*f*, the drain water in the drain receiver 10*f* is discharged outside of the room 17.

Each outlet unit 30 is formed in a substantially rectangular parallelepiped shape, for example, and on the bottom side, a substantially rectangular shaped outlet port 30*a* is formed. Further, on the bottom side of each outlet unit 30, as described above, an outlet grille 30*b* is provided so as to face the outlet port 30*a*. Furthermore, on the upper side of each outlet unit 30, for example, an outlet-side duct connecting portion 30*c* is protrudingly provided connecting the corresponding duct 19 thereto (in other words, inserted into the duct 19). That is, by connecting each duct 19 to the corresponding body-side duct connecting portion 21*a* and outlet-side duct connecting portion 30*c*, the body casing 10 and the corresponding outlet unit 30 are made to communicate with each other.

As described above, the indoor unit 50 of the air-conditioning apparatus 100 according to an exemplary embodiment is configured such that a greater number of ducts 19 can be connected to the body casing 10 than conventional ones. Thus, the indoor unit 50 of the air-conditioning apparatus 100 according to an exemplary embodiment can provide a greater number of outlet units 30 in the space 18 above the ceiling than conventional ones. In other words, the indoor unit 50 of the air-conditioning apparatus 100 according to an exemplary embodiment can provide outlet ports 30*a*, which can be disposed in arbitrary positions in planar view, in the room 17 in greater numbers than conventional ones.

Next, a configuration of an exemplary installation of the above-configured body casing 10 to the space 18 above the ceiling will be described.

As shown in FIGS. 4 and 5, a mounting bracket 5 is provided to each corner portion of the body casing 10 (that is, the connecting portion of the body sides 10*b*). A U-shape notch is formed in the side edge portion of each mounting bracket 5. As shown in FIG. 5, the body casing 10 is suspended and fixed in the space 18 above the ceiling by inserting an anchor bolt 7, which is embedded into the bottom side of the floor frame 8 of the upper floor, into the notch of each mounting bracket 5 and by screw fixing the top side and the bottom side of the mounting bracket with nuts screwed in the anchor bolt 7.

<Description of Operation>

Subsequently, an operation of the air-conditioning apparatus 100 according to an exemplary embodiment will be described.

First, the refrigerant flow during air conditioning operations (a cooling operation and a heating operation) of the air-conditioning apparatus 100 will be described. Then, the air flow during an air conditioning operation of the indoor unit 50 of the air-conditioning apparatus 100 will be described.

As described above, the air-conditioning apparatus 100 is connected by piping, such as in FIG. 6. Further, in the air-conditioning apparatus 100 during the cooling operation, the passage of the four-way valve 62 is set to the passage indicated by solid lines in FIG. 6 (the passage in which the discharge side of the compressor 61 is connected to the outdoor heat exchanger 63). That is, a gaseous refrigerant that is compressed into a high-temperature high-pressure state in the compressor 61 flows into the outdoor heat exchanger 63 through the four-way valve 62. The gaseous refrigerant that has flowed into the outdoor heat exchanger 63 is cooled by the outdoor air and is condensed, turning into a high-pressure liquid refrigerant. This high-pressure liquid refrigerant flows into the indoor unit 50 through the connecting piping 13*a*. The high-pressure liquid refrigerant that has flowed into the indoor unit 50 is decompressed by the expansion valve 6, turns into a low-temperature low-pressure, two-phase gas-liquid refrigerant, and flows into the indoor heat exchanger 16. The low-temperature low-pressure, two-phase gas-liquid refrigerant that has flowed into the indoor heat exchanger 16 cools the indoor air that is supplied from the centrifugal fan 1, is evaporated, and turns into a low-pressure gaseous refrigerant. This low-pressure gaseous refrigerant flows into the outdoor unit 60 through the connecting piping 13*b*. The low-pressure gaseous refrigerant that has flowed into the outdoor unit 60 is compressed into a high-temperature high-pressure gaseous refrigerant again by the compressor 61.

Further, in the air-conditioning apparatus 100 during the heating operation, the passage of the four-way valve 62 is set to the passage indicated by broken lines in FIG. 6 (the passage in which the discharge side of the compressor 61 is connected to the indoor heat exchanger 16). That is, a gaseous refrigerant that is compressed into a high-temperature high-pressure state in the compressor 61 flows into the indoor heat exchanger 16 through the four-way valve 62 and the connecting piping 13*b*. The gaseous refrigerant that has flowed into the indoor heat exchanger 16 heats the indoor air that is supplied from the centrifugal fan 1, is condensed, and turns into a high-pressure liquid refrigerant. This high-pressure liquid refrigerant is decompressed by the expansion valve 6, turning into a low-temperature low-pressure two-phase gas-liquid refrigerant. This low-temperature low-pressure, two-phase gas-liquid flows into the outdoor unit 60 through the connecting piping 13*a*. The low-temperature low-pressure, two-phase gas-liquid that has flowed into the outdoor unit 60 flows into the outdoor heat exchanger 63. The low-temperature low-pressure, two-phase gas-liquid refrigerant that has flowed into the outdoor heat exchanger 63 is heated by the outdoor air, is evaporated, and turns into a low-pressure gaseous refrigerant. This low-pressure gaseous refrigerant is compressed into a high-temperature high-pressure gaseous refrigerant again by the compressor 61.

Next, the air flow during an air conditioning operation of the indoor unit 50 of the air-conditioning apparatus 100 will be described. When the air conditioning operation is started, the fan motor 15 provided in the body casing 10 of the indoor unit 50 is rotatably driven. With the above, as shown in FIG. 4, the centrifugal fan 1 provided in the body casing 10 rotates in the arrow A direction, pivoting around the center O of the rotation axis of the fan (in other words, the motor rotating shaft 15*a* of the fan motor 15). With the above rotation of the centrifugal fan 1, the air in the room 17 is sucked into the body casing 10. More specifically, the air in the room 17 flows into the filter 12 through the inlet grille 11*a*, and dust is removed in the filter 12. The dust-removed air is sucked into the centrifugal fan 1 from the fan suction port 1*a* after passing through the body inlet port 10*c* and the bell mouth 14. Here, the body inlet port 10*c* of the indoor unit 50 is disposed in the substantially middle portion of the room 17 in planar view. Accordingly, the indoor unit can circulate air in the room 17 in a satisfactory manner.

The air that has been sucked into the centrifugal fan 1 is discharged to the indoor heat exchanger 16 from the fan discharge port 1*b*. The air that has been discharged to the indoor heat exchanger 16 is, as described above, cooled or heated by the refrigerant that is flowing in the indoor heat exchanger 16, is turned into conditioned air, and flows out of the body casing 10 through the body outlet ports 10*d*. Here, in the indoor unit 50, since the indoor heat exchanger 16, in planar view, is disposed so as to surround the centrifugal fan 1, the conditioned air can be discharged to each of the body outlet port 10*d* formed in each body side 10*b* of the body casing 10 in a substantially uniform manner.

The conditioned air that has flowed out from the body outlet ports 10*d* is distributed to each duct 19 through corresponding joints 21. Further, the conditioned air that has been distributed to each duct 19 is discharged into the room 17 from the outlet ports 30*a* of the outlet units 30 that is connected to each duct 19. Accordingly, the room 17 is air conditioned. Here, as described above, the joints 21 have deformed portions 21*b* (portions shaped such that the sections from the connection portion with the body outlet port 10*d* to the body-side duct connecting portion 21*a* gradually deforms its shape from a rectangular into a circle while reducing its cross-sectional area). Accordingly, in the indoor unit 50, increase of pressure loss can be suppressed while the passage of the conditioned air deforms from the substantially rectangular shape of the large opening of each body outlet port 10*d* to a circular cross-sectional shape of the duct 19. Further, as described above, in the indoor unit 50, since at least one duct 19 can be connected to each and every body side 10*b* of the body casing 10 through the joint 21, the bending angle of each duct 19 is 90 degrees or less and, further, the length of each duct 19 is made short. Accordingly, the indoor unit 50 can reduce ventilation resistance when the conditioned air is supplied to the outlet units 30. Furthermore, as described above, a greater number of ducts 19 compared to conventional ones, eight in number, are connected to the body sides 10*b* of the body casing 10 through joints 21. Accordingly, the indoor unit 50 can further reduce ventilation resistance when the conditioned air is supplied to the outlet units 30. Furthermore, in the indoor unit 50, since a greater number of ducts 19 compared to conventional ones, eight in number, is connected, conditioned air can be supplied to the room 17 through a greater number of outlet ports 30*a* of the outlet units 30 than conventional ones.

The air-conditioning apparatus 100 configured as an exemplary embodiment is configured such that at least one duct 19 can be connected to each and every body side 10*b* of the body casing 10 through a joint 21. Thus, the body casing 10 can be disposed in the middle area of the room 17. Accordingly, satisfactory circulation of the air in the room 17 can be achieved. Furthermore, since the indoor heat exchanger 16, in planar view, is disposed so as to surround the centrifugal fan 1, the conditioned air can be distributed to each of the ducts 19 connected to the body side 10*b* of the body casing 10 through the joint 21 in a substantially uniform manner. That is, the conditioned air can be distributed to each outlet unit 30 that are disposed in arbitrary positions (in all four directions of the room, for example) in a substantially uniform manner. Furthermore, in the air-conditioning apparatus 100 according to an exemplary embodiment, since eight ducts 19, which is greater in number than conventional ones, can be connected to the body casing 10 through the joint 21, a greater number of outlet units 30 can be provided thereto. That is, in the air-conditioning apparatus 100 according to an exemplary embodiment, conditioned air can be supplied to the room 17 from a greater number of outlet ports 30*a* of the outlet units 30 than conventional ones. Thus, in the air-conditioning apparatus 100 according to an exemplary embodiment, nonuniformity of temperature in the room 17 is eliminated and comfortability is improved.

Additionally, as described above, the air-conditioning apparatus 100 according to an exemplary embodiment is configured such that at least one duct 19 can be connected to each and every body side 10*b* of the body casing 10 through the joint 21. Accordingly, in the air-conditioning apparatus 100 according to an exemplary embodiment, the bending angle of the ducts 19 can be 90 degrees or less when connecting the body casing 10 and the outlet units 30 with the ducts 19. Additionally, in the air-conditioning apparatus 100 according to an exemplary embodiment, since the body casing 10 can be disposed in the middle area of the room 17, the length of each duct 19 may be made short. Furthermore, in the air-conditioning apparatus 100 according to an exemplary embodiment, as described above, since a plurality of ducts 19 can be connected to each of the body sides 10*b* of the body casing 10 through the joint 21, a greater number of outlet units 10, eight in number, can be connected to the body casing 10 than conventional ones. Accordingly, the air-conditioning apparatus 100 of an exemplary embodiment is capable of reducing ventilation resistance while conditioned air is supplied to the outlet units 30, and thus is capable of reducing the torque of the fan motor 15 rotatably driving the centrifugal fan 1 to maintain the required air volume and reducing the power consumption of the fan motor 15. Accordingly, the air-conditioning apparatus 100 of an exemplary embodiment can be an air-conditioning apparatus that has high energy savings (high energy efficiency) and low noise.

In addition, in the air-conditioning apparatus 100 according to an exemplary embodiment, since the joints 21 include deformed portions 21*b*, increase of pressure loss can be suppressed while the passage of the conditioned air is deformed from the substantially rectangular shape of the large opening of each body outlet port 10*d* to a circular cross-sectional shape of the duct 19. Accordingly, the air-conditioning apparatus 100 of an exemplary embodiment can be an air-conditioning apparatus with even higher energy savings.

Additionally, in the air-conditioning apparatus 100 of an exemplary embodiment, as regards the plurality of body-side duct connecting portion 21*a* protrudingly provided to the same joint 21, in planar view, the end of the neighboring body-side duct connecting portions 21*a* are protruded so as to part from each other. Thus, when connecting the ducts 19 to the neighboring body-side duct connecting portions 21*a*, since the ducts 19 will not easily bump into to each other, it is easier to turn and remove the ducts 19. Accordingly, the air-conditioning apparatus 100 of an exemplary embodiment can be an air-conditioning apparatus with high workability.

Further, in the air-conditioning apparatus 100 of an exemplary embodiment, the outlet units 30 are each disposed away from the body casing 10 at a predetermined distance. Furthermore, in the air-conditioning apparatus 100 according to an exemplary embodiment, since conditioned air can be supplied to the room 17 from a greater number of outlet ports 30*a* of the outlet units 30 than conventional ones, outlet ports do not have to be provided to the body casing 10. That is, the air-conditioning apparatus 100 according to an exemplary embodiment does not dispose outlet ports in the vicinity of the body inlet port 10*c*. Thus, since the air-conditioning apparatus 100 according to an exemplary embodiment can prevent occurrence of short cycles that hinder the air conditioning of the room 17, wasted power consumed during air conditioning of the room 17 can be suppressed, and accordingly, the air conditioning apparatus can be one with high energy savings.

Figure 7:
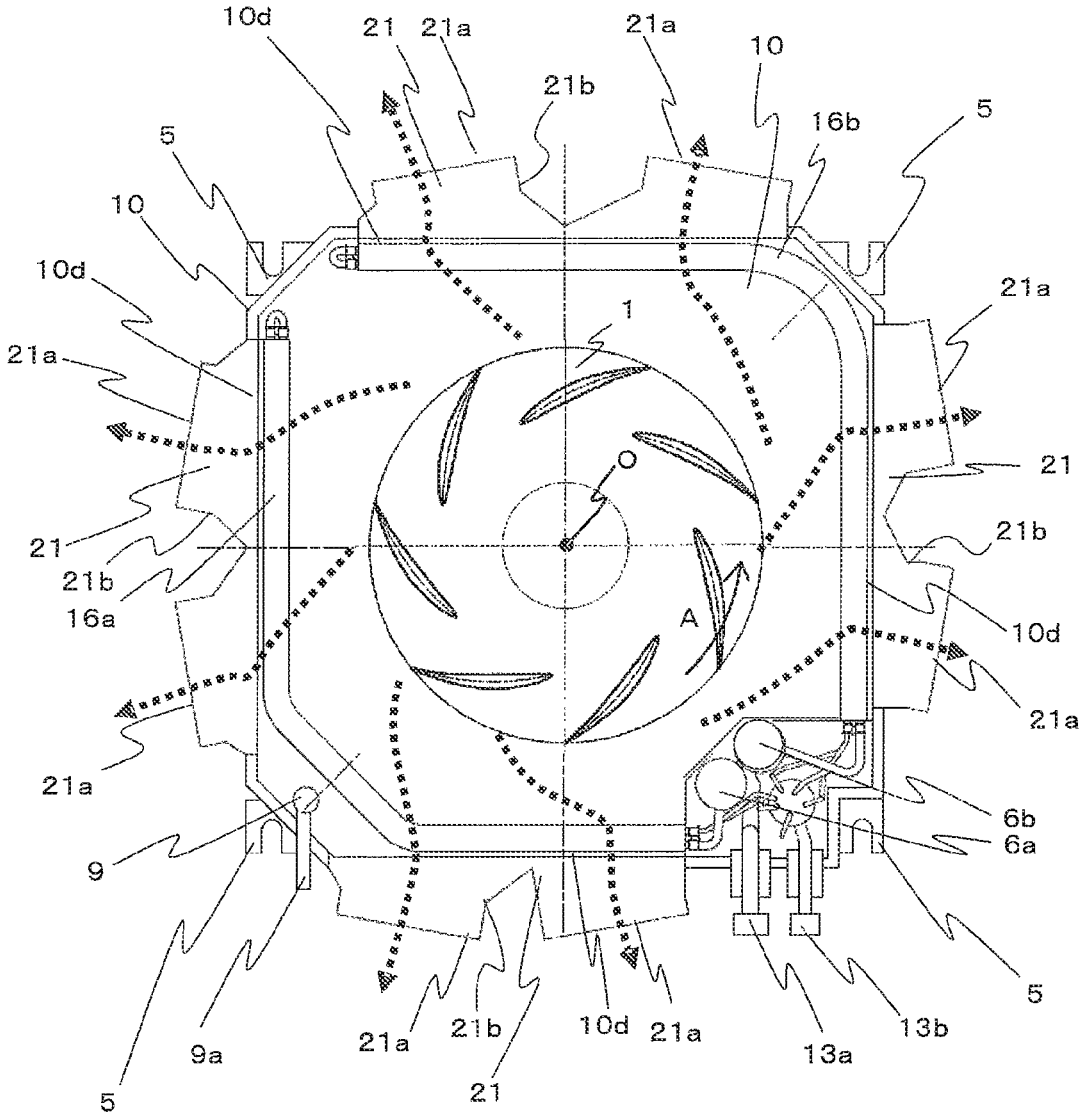
FIG. 7 is a cross sectional view of another example of the air-conditioning apparatus according to an exemplary embodiment of the disclosure illustrating the body casing of the indoor unit taken along a virtual plane orthogonal to a rotation shaft of a centrifugal fan.

It should be noted that although in an exemplary embodiment, the indoor heat exchanger 16 is formed as a single part, the indoor heat exchanger may be a plurality of divided heat exchangers in planar view. For example, as shown in FIG. 7, the indoor heat exchanger 16 may be a substantially rectangular shape in planar view including a substantially L-shape heat exchanger 16*a* in planar view and a substantially inverted L-shape heat exchanger 16*b* in planar view. Further, for example, the indoor heat exchanger 16 may be configured such that four substantially I-shape heat exchangers are disposed in a substantially rectangular shape in planar view. As above, by configuring the indoor heat exchanger 16 with a plurality of divided heat exchangers in planar view, compared to forming a substantially rectangular shape by bending a single heat exchanger, that is, compared to manufacturing a single part type indoor heat exchanger 16, the space required to manufacture the indoor heat exchanger 16 can be reduced and workability during manufacture of the indoor heat exchanger 16 can be improved.

Furthermore, when the indoor heat exchanger 16 is configured with the plurality of divided heat exchangers in planar view, an expansion valve may be connected to each of the heat exchangers. For example, as in FIG. 7, when the indoor heat exchanger 16 is constituted by two heat exchangers 16*a* and 16*b*, a refrigerant circuit may be configured such as the one in FIG. 8, for example. That is, the expansion valve 6*a* may be provided between the heat exchanger 16*a* and the outdoor heat exchanger 63, and the expansion valve 6*b* may be provided between the heat exchanger 16*b* and the outdoor heat exchanger 63. By connecting an expansion valve to each of the plurality of divided heat exchangers constituting the indoor heat exchanger 16, temperature (more specifically, the temperature of the refrigerant that flows in each heat exchanger) of each heat exchanger constituting the indoor heat exchanger 16 may be changed. Accordingly, the conditioned air discharged from the outlet ports 30*a* of each outlet units 30 may be of a plurality of temperatures, thus comfortability in the indoor room 17 is improved. It should be noted that although in FIG. 8, the heat exchangers 16*a* and 16*b* are connected in parallel, the same advantageous effect can be obtained by connecting the heat exchangers 16*a* and 16*b* in series.

Figure 9:
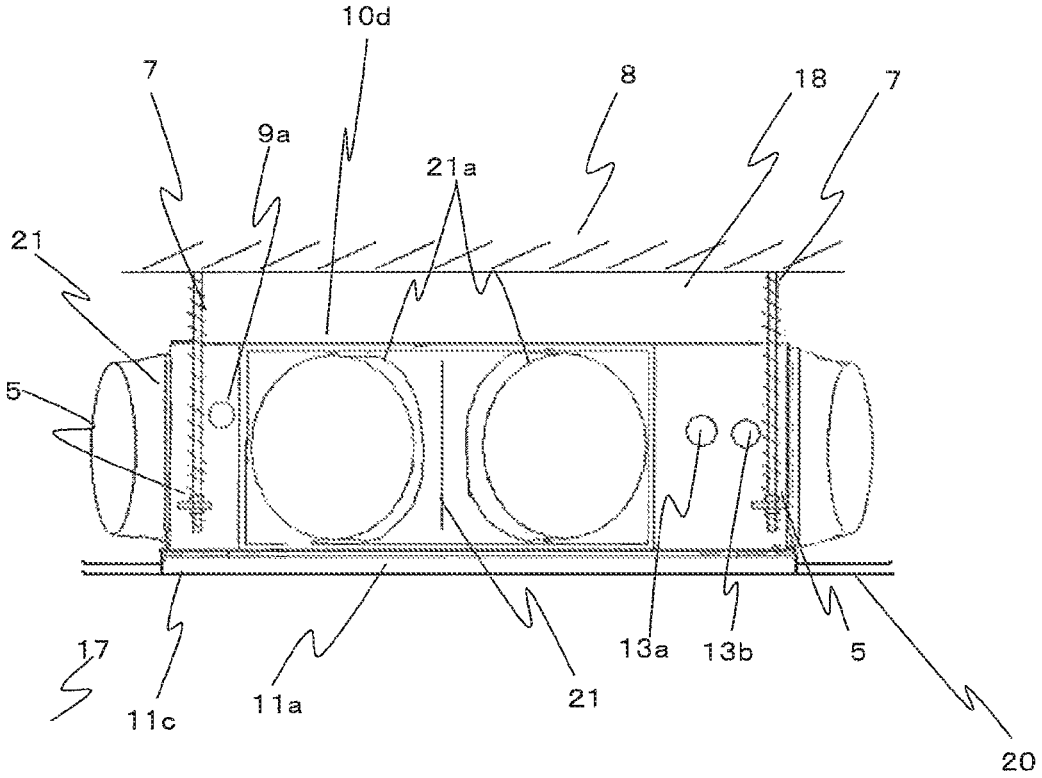
FIG. 9 illustrates a state in which the body casing of the indoor unit of the air-conditioning apparatus according to an exemplary embodiment of the disclosure is disposed in a gridded ceiling.

Further, when the ceiling of the room 17 is a gridded ceiling (a suspended ceiling), the body casing 10 of the indoor unit 50 may be installed as shown in FIG. 9. The gridded ceiling, that is, the ceiling surface 20 is formed by fitting ceiling materials to a ceiling frame in which the size of the width×length is 2 ft×2 ft (two by two, about 600 mm square), 4 ft×4 ft (four by four, about 1300 mm square), and standard sizes such as two-by-four. Thus, when the ceiling of the room 17 is a gridded ceiling (a suspended ceiling), by forming the decorative panel 11*c* so as to have a substantially same size as that of the ceiling material (that is, the ceiling frame in which the ceiling material is fitted into) and by disposing the decorative panel 11*c* and the ceiling surface 20 on a substantially same plane, the body casing 10 of the indoor unit 50 can be mounted to the space 18 above the ceiling. By disposing the decorative panel 11*c* and the ceiling surface 20 on a substantially same plane, the decorative panel will not project out into the room 17. Thus, occupants in the room 17 will not feel oppressed and the living comfortability of the room 17 is improved.

Furthermore, although an example in which the indoor unit 50 is disposed in the space 18 above the ceiling has been illustrated in an exemplary embodiment, if there is no space 18 above the ceiling of the room 17, it is needless to say that the indoor unit 50 may be disposed on the ceiling of the room 17 in an exposed manner.

Figure 10:
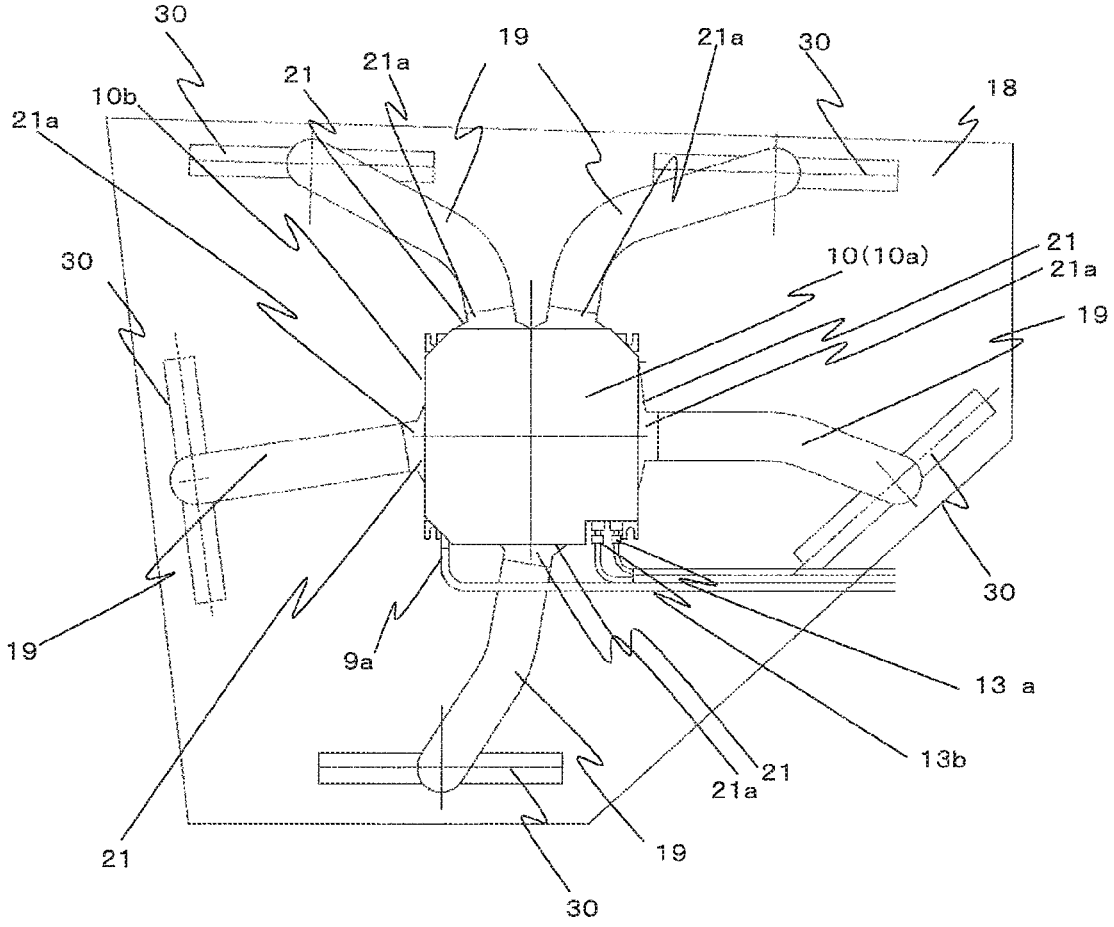
FIG. 10 is a schematic diagram (plan view) of the installation state of another example of the air-conditioning apparatus according to an exemplary embodiment of the disclosure viewed from a space above a ceiling.

Additionally, although in an exemplary embodiment, the indoor unit 50 in which eight ducts 19 are connected to the entirety of the body casing 10 is described, if five ducts 19 in the least can be connected to the body casing 10 in total as shown in FIG. 10, for example, the disclosure can be embodied. That is, if two ducts 19 can be connected to at least one body side 10*b* of the body casing 10 through the joint 21, then more than five ducts 19, which is greater in number than conventional ones, can be connected to the entirety of the body casing 10, and, thus, the same advantageous effect as above can be obtained.

Further, in an exemplary embodiment, no description in particular has been made regarding which body side 10*b* of the body casing 10 may the joint 21, which is protrudingly provided with a plurality of body-side duct connecting portions 21*a*, be provided. For example, the joint 21, which is protrudingly provided with a plurality of body-side duct connecting portions 21*a*, may be provided as below. There are cases in which the room 17 is not of a square shape in planar view but is of a rectangular shape, for example. Furthermore, in a room in a corner of a building, a house, or the like, there are cases in which the room 17 is not of a square shape or a rectangular shape in planar view. That is, there are cases in which the room 17 in planar view may have a wall with a longer side and a wall with a shorter side. In the above, there are cases in which a plurality of outlet units 30 is provided in the space 18 above the ceiling, along the wall of the room with the longer side in planar view. For example, in FIG. 10, two outlet units 30 are provided along the wall of the room 17 (in other words, the space 18 above the ceiling) with the longest side in planar view. This is because, in a vicinity of a wall of a room 17 with a longer side in planar view, there is a concern that conditioned air supplied from only one outlet unit 30 is not sufficient to maintain a comfortable temperature. In such a case, as shown in FIG. 10, a joint 21 protrudingly provided with two body-side duct connecting portions 21*a* may be provided to the body side 10*b* of the body casing 10 that faces the wall of the room 17 with the longest side in planar view (that is, the wall provided with two outlet units 30 in its vicinity). With the above configuration, the length of the duct 19 connected to the outlet unit 30 that is provided in the vicinity of the wall of the room 17 with the longest side in planar view can be short, and the bending angle of these ducts 19 can be within 90 degrees. That is, the ventilation resistance while supplying conditioned air to the outlet unit 30 can be reduced, and an indoor unit 50 that has high energy savings (high energy efficiency) and that has low noise can be obtained.

What is claimed is:

1. An air-conditioning apparatus, for being disposed in a ceiling of a room comprising:

a body casing of an indoor unit that is formed into a substantially rectangular parallelepiped shape by a top, a bottom, and four lateral sides extending between the top and the bottom, the body casing being formed with a body inlet port on the bottom, and being formed with a body outlet port on each of the four lateral sides;

a centrifugal fan provided inside the body casing;

a fan motor for rotatably driving the centrifugal fan;

an indoor heat exchanger provided inside the body casing, the indoor heat exchanger being disposed so as to substantially surround an outer periphery of the centrifugal fan in planar view;

a joint provided in each body outlet port, the joint being protrudingly provided with a body-side duct connecting portion that is connected to a duct; and a plurality of outlet units each provided with an outlet-side duct connecting portion that is connected to the duct, each of the outlet units being connected to one of the body-side duct connecting portions through the duct and being formed with an outlet port on a bottom side thereof, wherein at least one joint is formed with a plurality of the body-side duct connecting portions, at least one duct connected to each of the lateral sides of the body casing through the joint, and at least five ducts connected to the entirety of the body casing.

2. The air-conditioning apparatus of claim 1, wherein in the plurality of the body-side duct connecting portions formed in the same joint, ends of the neighboring body-side duct connecting portions are protruded so as to part from each other in planar view.

3. The air-conditioning apparatus of claim 1, wherein the body outlet port is opened in a rectangular shape, the body-side duct connecting portion has a round section, and the joint has a deformed portion that gradually deforms its shape from a rectangular into a circle from the connection portion with the body outlet port to the body-side duct connecting portion while reducing its cross-sectional area.

4. The air-conditioning apparatus of claim 1, wherein the indoor heat exchanger is constituted by a plurality of divided heat exchangers in planar view.

5. The air-conditioning apparatus of claim 4, wherein an expansion valve is connected to each of the divided heat exchangers, the expansion valve expanding a refrigerant flowing into the heat exchangers or the refrigerant flowing out of the heat exchangers.

6. A configuration of installation of the air-conditioning apparatus of claim 1, wherein the joint formed with the body-side duct connecting portions is provided to at least the body outlet port in the body side of the body casing that faces a wall of the room with a longest side in planar view.

7. An air-conditioning apparatus, for being disposed in a ceiling of a room comprising:

a body casing of an indoor unit that is formed into a substantially rectangular parallelepiped shape by a top, a bottom, and four lateral sides extending between the top and the bottom, the body casing being formed with a body inlet port on the bottom, and being formed with a body outlet port on each of the four lateral sides;

a centrifugal fan provided inside the body casing;

a fan motor for rotatably driving the centrifugal fan;

an indoor heat exchanger provided inside the body casing, the indoor heat exchanger being disposed so as to substantially surround an outer periphery of the centrifugal fan in planar view; and a joint provided in each body outlet port, the joint being protrudingly provided with a body-side duct connecting portion that is connected to a duct, wherein at least one joint is formed with a plurality of the body-side duct connecting portions, and in the plurality of the body-side duct connecting portions formed in the same joint, ends of the neighboring body-side duct connecting portions are protruded so as to part from each other in planar view.

* * * * *